United States Patent [19]

Fukuda et al.

[11] Patent Number: 4,721,482

[45] Date of Patent: Jan. 26, 1988

[54] CONNECTOR HOUSING

[75] Inventors: Kiyohito Fukuda; Masanori Tsuji; Sumio Nagano, all of Kosai, Japan

[73] Assignee: Yazaki Corporation, Tokyo, Japan

[21] Appl. No.: 15,205

[22] Filed: Feb. 13, 1987

[30] Foreign Application Priority Data

Feb. 18, 1986 [JP] Japan ..... 61-031911

[51] Int. Cl.[4] ..... H01R 13/40

[52] U.S. Cl. ..... 439/595; 439/586

[58] Field of Search ..... 339/43, 44, 59–61, 339/63, 75, 76, 78

[56] References Cited

U.S. PATENT DOCUMENTS

| | | | |
|---|---|---|---|
| 3,842,388 | 10/1974 | Harwood et al. | 339/59 R |
| 4,295,698 | 10/1981 | Chew | 339/59 R |
| 4,410,226 | 10/1983 | Adduci et al. | 339/44 R |
| 4,413,872 | 11/1983 | Rudy, Jr. et al. | 339/59 M |
| 4,583,805 | 4/1986 | Mantlik | 439/595 |
| 4,674,814 | 6/1987 | Hoshino et al. | 439/586 |
| 4,679,874 | 7/1987 | Saijo et al. | 439/595 |
| 4,679,884 | 7/1987 | Klamp | 439/595 |

FOREIGN PATENT DOCUMENTS 59-3879 1/1984 Japan .

*Primary Examiner*—Gil Weidenfeld
*Assistant Examiner*—Paula A. Austin
*Attorney, Agent, or Firm*—Armstrong, Nikaido, Marmelstein & Kubovcik

[57] ABSTRACT

A connector housing comprising a housing body having a terminal receiving chamber for receiving a terminal connected with a lead wire, a tapered portion formed on an inner wall of the terminal receiving chamber in such a manner as to be converged in a direction of insertion of the terminal, and first and second locking means formed on an outer periphery of the housing body; a cover for preventing disengagement of the terminal, having first and second engaging portions to be engaged with the first and second locking means, respectively, a terminal insertion hole into which the terminal is inserted, and a flexible projection provided around the terminal insertion hole; and an elastically deformable soft band for integrally connecting the housing body with the cover; wherein the terminal is inserted under a first engaging condition where the second locking means of the housing body is merely in contact with the second engaging portion of the cover, and the flexible projection is urged along the tapered portion to stop a rear end of the terminal under a second engaging condition where the second locking means is fixedly engaged with the second engaging portion.

6 Claims, 21 Drawing Figures

CONNECTOR HOUSING

BACKGROUND OF THE INVENTION

The present invention relates to a connector housing into which an electrical connection terminal may be easily inserted, having means for preventing incomplete insertion of the terminal and means for preventing disengagement of the terminal.

Conventional means for preventing incomplete insertion of the terminal and preventing disengagement of the terminal is disclosed in Japanese Patent Laid-open No. 59-3879.

In this prior art with reference to FIGS. 13 to 16, a connector housing 1 includes two terminal receiving chambers 2 into which each terminal 4 preliminarily connected with a lead wire 3 is mounted. A cover 6 for preventing disengagement of the terminal is integrally connected through a soft band 5 to the housing 1. Firstly, the cover 6 is in an open condition as shown by a solid line in FIG. 14, and the terminal 4 is inserted into the terminal receiving chamber 2 until it is engaged with a flexible arm 7 projecting into the terminal receiving chamber 2.

Then, the cover 6 is covered on a terminal insertion opening portion of the housing 1, and is urged against the housing 1, thereby engaging holes 8 formed on both side surfaces of the cover 6 with projections 9 formed at the opening end of the housing 1. The cover 6 is formed with projections 11 acting to urge engagement portions 10 formed at the rear end portion of the terminal 4, thereby preventing disengagement of the terminal 4.

However, the afore-mentioned prior art includes the following drawbacks.

(a) As shown in FIG. 17, before the cover 6 is mounted on the housing 1, the terminal 4 must be inserted into the terminal receiving chamber 2, so as to stop the terminal 4 with the lead wire 3 by the projections 11. However, if the terminal 4 with the lead wire 3 is firstly inserted, the lead wire 3 cannot pass through a lead wire insertion opening **6*a* defined between a pair of projections 11, rendering a mounting work of the cover 6** difficult.

(b) In another type of the connector housing 1' having three terminal receiving chambers 2' as shown in FIG. 19, configuration of projections 11' of a cover 6' and projections 9' of the housing 1' is complicated to render a mounting work of the cover 6 difficult. Especially, it is difficult to uniformly fix a plurality of terminals.

SUMMARY OF THE INVENTION

It is an object of the present invention to provide a connector housing which permits a terminal connected with a lead wire to be easily inserted into a terminal receiving chamber.

It is another abject of the present invention to provide a connector housing which permits a cover for preventing disengagement of the terminal to be easily engaged with the housing body without hindrance of the lead wire even after the terminal is inserted into the terminal receiving chamber.

It is a further object of the present invention to provide a connector housing which may prevent disengagement of the terminal easily and reliably.

It is a still further object of the present invention to provide a connector housing which may uniformly fix the terminals irrespective of the number of the terminal receiving chamber.

According to the present invention, there is provided a connector housing comprising a housing body having a terminal receiving chamber for receiving a terminal connected with a lead wire, a tapered portion formed on an inner wall of the terminal receiving chamber in such a manner as to be converged in a direction of insertion of the terminal, and first and second locking means formed on an outer periphery of the housing body; a cover for preventing disengagement of the terminal, having first and second engaging portions to be engaged with the first and second locking means, respectively, a terminal insertion hole into which the terminal is inserted, and a flexible projection provided around the terminal insertion hole; and an elastically deformable soft band for integrally connecting the housing body with the cover; wherein the terminal is inserted under a first engaging condition where the second locking means of the housing body is merely in contact with the second engaging portion of the cover, and the flexible projection is urged along the tapered portion to stop a rear end of the terminal under a second engaging condition where the second locking means is fixedly engaged with the second engaging portion.

Other objects and features of the invention will be more fully understood from the following detailed description and appended claims when taken with the accompaning drawings.

Figure 11:
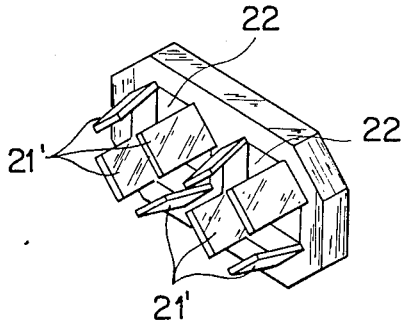
FIG. 11 is a perspective view of the flexible projection of another preferred embodiment.
Figure 13:
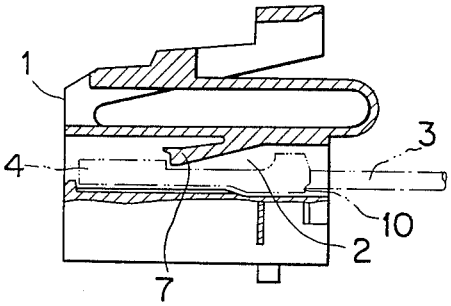
FIG. 13 PRIOR ART
Figure 14:
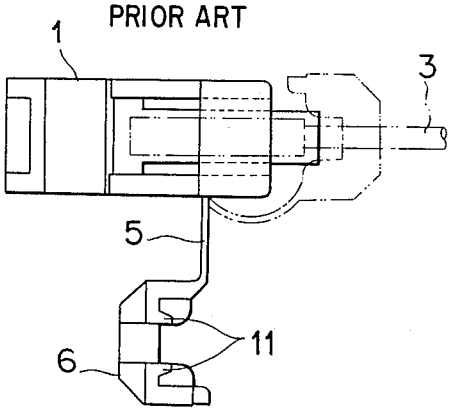
FIG. 14 PRIOR ART
Figure 15:
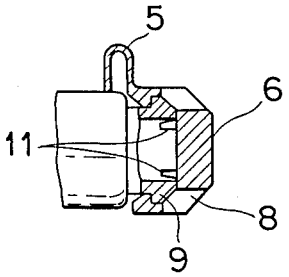
FIG. 15 PRIOR ART
Figure 16:
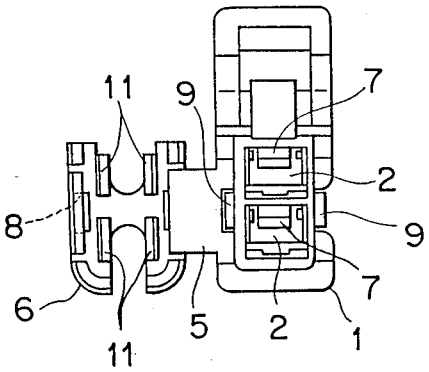
FIG. 16 PRIOR ART
Figure 17:
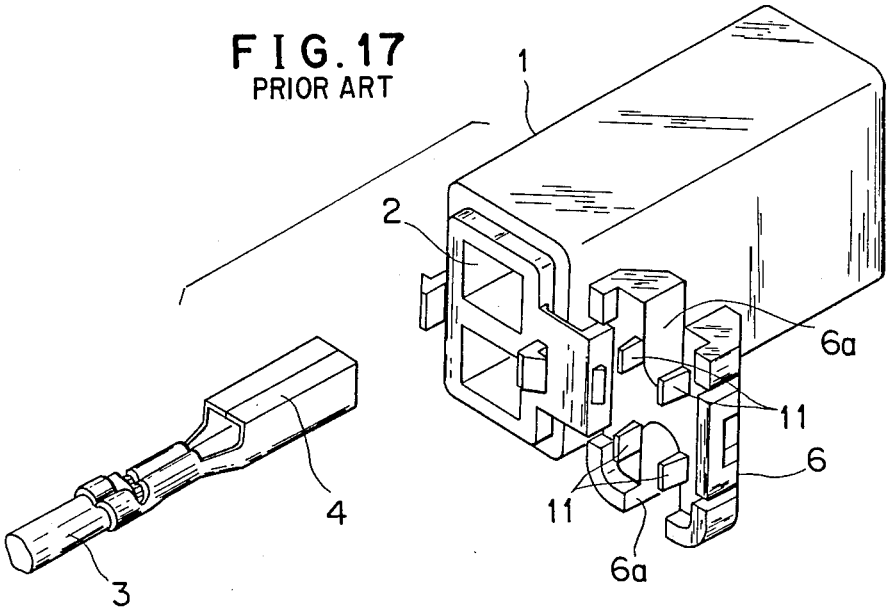
FIG. 17 PRIOR ART
Figure 18:
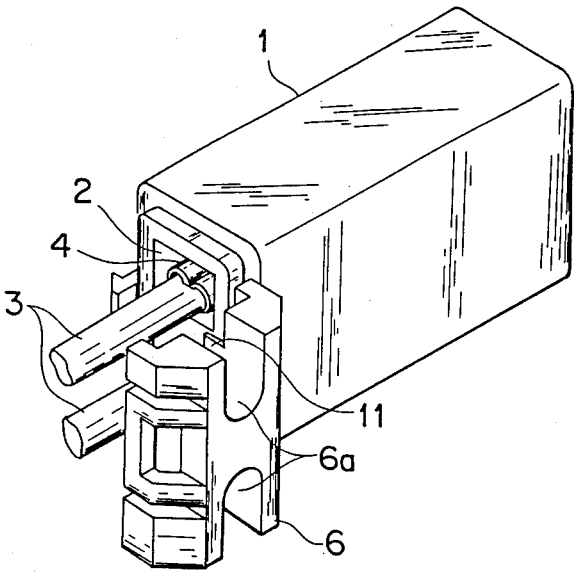
Figure 19:
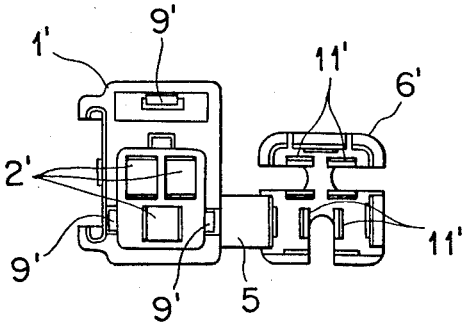

FIGS. **12*a*, 12*b* and 12*c* are sectional views showing the relation between the flexible projection of FIG. 11** and the terminal;

FIG. 13 is a sectional view of the connector housing having two terminal insertion holes in the prior art;

FIG. 14 is an elevational view of the connector housing of FIG. 13;

FIG. 15 is a sectional view of the essential part of the connector housing of FIG. 13;

FIG. 16 is a side view of the connector housing of FIG. 13;

FIG. 17 is a perspective view of the connector housing of FIG. 13 before inserting the terminal thereinto;

FIG. 18 is a perspective view of the connector housing of FIG. 13 after inserting the terminal thereinto; and FIG. 19 is a side view of the connector housing having three terminal insertion holes of another example in the prior art.

DETAILED DESCRIPTION OF THE PREFERRED EMBODIMENTS

There will be now described some preferred embodiments of the present invention with reference to the drawings, in which the same parts as of the prior art connector housing as mentioned above are designated by the same reference numerals.

First Preferred Embodiment

Referring to FIGS. 1 to 5, a housing body 1 is formed with two terminal receiving chambers 2 inside thereof. Each of the terminal receiving chambers 2 is formed at its inner wall with a flexible stopper arm 7 projecting centrally and with a tapered portion 12 converging in a direction of insertion of a terminal.

The housing body 1 is provided with a pair of first locking portions 13 projecting from both side surfaces of the outer periphery thereof, and is also provided with second locking portions 14 and 15 at an upper central portion and lower both ends thereof, respectively.

A cover 6 for preventing disengagement of the terminal is integrally connected through a soft band 6 with the housing body 1. The cover 6 is formed with a pair of elongate holes 16, and there is provided at a front end of each elongate hole 16 with a first engaging portion 17 adapted to be engaged with each first locking portion 13.

Figure 4:
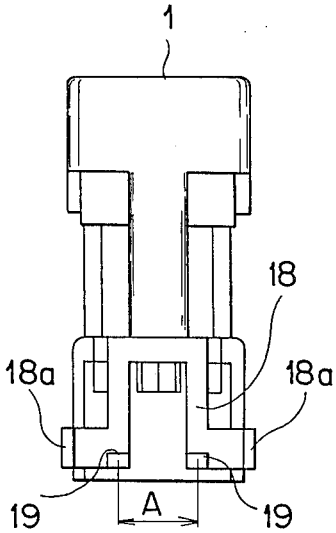
FIG. 4 is a plan view of the connector housing of FIG. 1.
Figure 5:
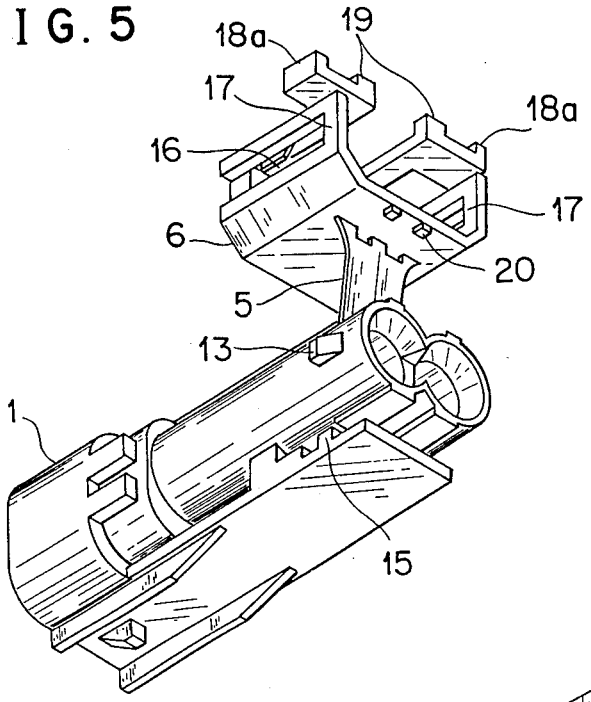
FIG. 5 is a perspective view of the connector housing of FIG. 1.

As shown in FIG. 4, a U-shaped plate-like flexible member 18 is provided at an upper rear end of the cover 6. There are provided second engaging portions 19 and 20 at centrally opposite positions of upper front end of the flexible member and at a central position of lower front end of the cover 6, respectively.

A distance A between the opposite positions of the second engaging portions 19 is normally equal to a distance B between the second locking portions 15. However, the distance A may be reduced by inwardly pressing both side surfaces 18*a* of the flexible member 18 and easily elastically deforming the flexible member 18.

Figure 6:
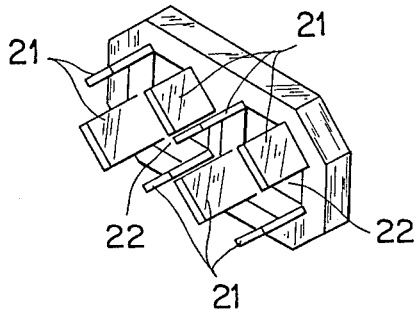
FIG. 6 is a perspective view of a flexible projection.

As shown in FIG. 6, the cover 6 includes a pair of terminal insertion holes 22, and there are provided four tongue-like flexible projection members 21 around each terminal insertion holes 22 in such a manner as to be arranged in parallel relationship with an axis of each terminal receiving chamber 2 at a position opposite to the terminal receiving chamber 2 after mounting the cover to the housing body 1.

Figure 1:
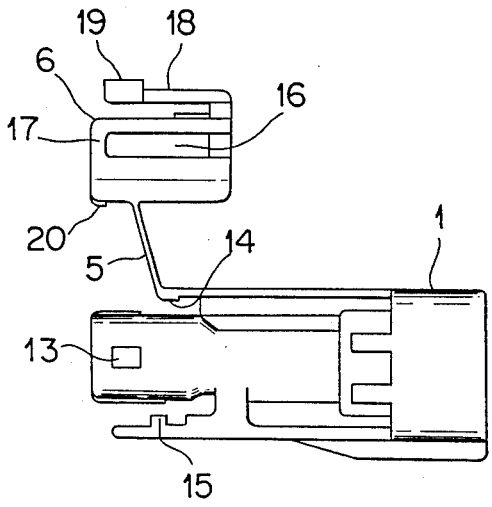
FIG. 1 is an elevational view of a connector housing of a preferred embodiment according to the present invention.
Figure 3:
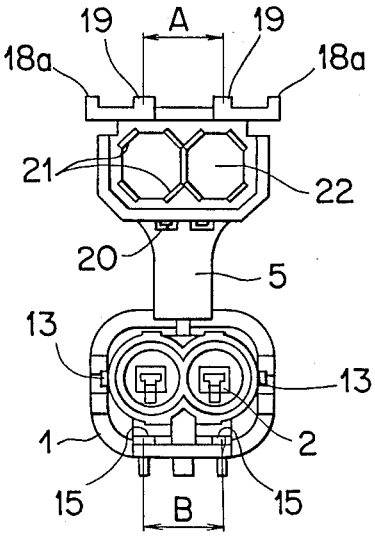
FIG. 3 is a side view of the connector housing of FIG. 1.
Figure 2:
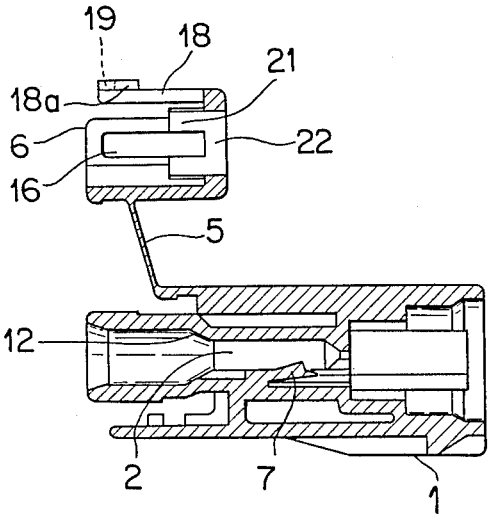
FIG. 2 is a sectional view of the connector housing of FIG. 1.

In operation, firstly the cover 6 is kept upright over the housing body 1 owing to the elasticity of the soft band 5 as shown in FIG. 2.

Figure 7:
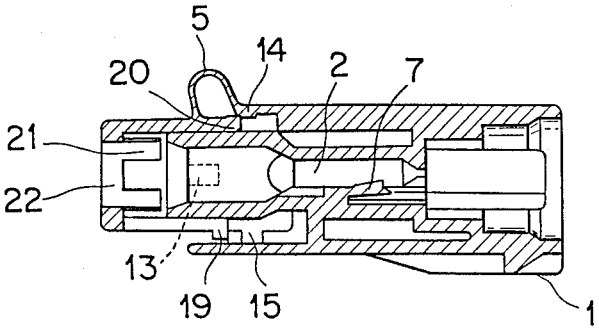
FIG. 7 is a sectional view of the connector housing under the first engaging condition.
Figure 8:
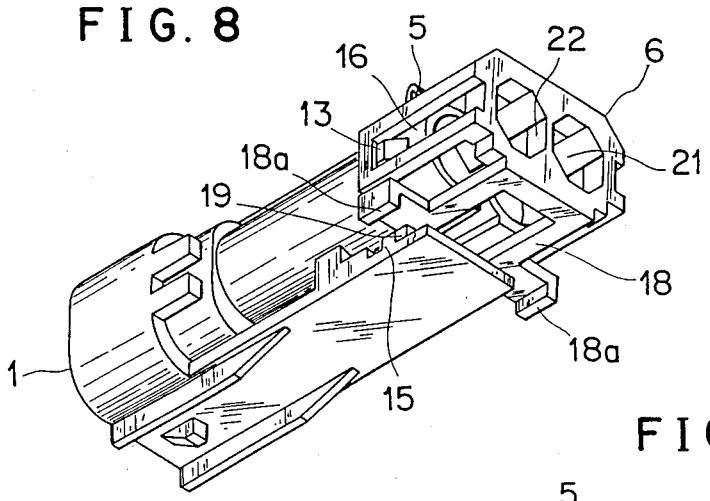
FIG. 8 is a perspective view of the connector housing under the first engaging condition.

When the cover 6 is engaged with the housing body 1, and is lightly pushed rearwardly as shown in FIGS. 7 and 8, the first locking portions 13 pass over the first engaging portions 17, and engage with the elongate holes 16. At this time, the second locking portions 14 and 15 are merely brought into contact with the second engaging portions 20 and 19, respectively.

Under the above condition, the cover 6 is inhibited from moving forwardly and rearwardly relative to the housing body 1, thus maintaining a primary stable mounting (temporary mounting) condition (first engaging condition).

Figure 9:
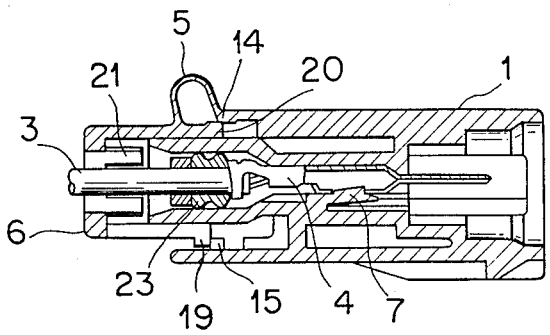
FIG. 9 is a sectional view of the connector housing after inserting a terminal thereinto.

Under the first engaging condition, since the terminal insertion hole 22 of the cover 6 is substantially axially aligned with the terminal receiving chamber 2 of the housing body 1, the terminal 4 connected with the lead wire 3 may be easily inserted into the terminal receiving chamber 2 as shown in FIG. 9.

While the terminal 4 deeply inserted into the terminal receiving chamber 2 is engaged with the flexible stopper arem 7, and is prevented from being disengaged, a large diameter rubber plug 23 of the terminal 4 is spaced apart from the flexible projection members 21.

Figure 10:
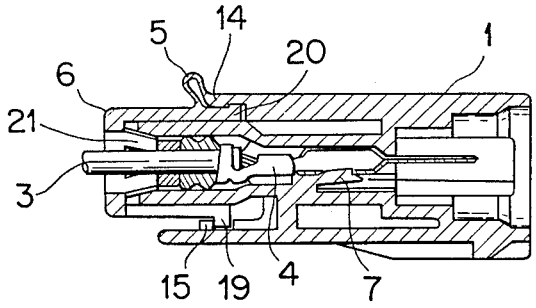
FIG. 10 is a sectional view of the connector housing under the second engaging condition.

Then, both the side surfaces 18*a* of the flexible member 18 are inwardly pressed to centrally move the second engaging portions 19, and the cover 6 is urged against the housing body 1 is such a manner that the second engaging portions 19 are hindered from abutting against the second locking portions 15. Then, the pressing force applied to the side surfaces 18*a* is removed to engage the second locking portions 14 with the second engaging portions 20 and also engage the second locking portions 15 with the second engaging portions 19 as shown in FIG. 10. Thus, the cover 6 is completely mounted to the housing body 1 (second engaging condition).

The flexible projection members 21 are inserted into the tapered portion 12 is such a manner that the free ends of the flexible projection members 21 are converged along the tapered portion 12 during insertion. However, in the event that the terminal 4 is not completely inserted into the terminal receiving chamber, and is not engaged with the flexible stopper arm 7, the rubber plug 23 of the terminal 4 is pushed by the cover 6 to thereby ensure a proper engaging condition of the terminal 4.

Thus, the flexible projection members 21 function to prevent incomplete insertion of the terminal 4 and also function as a stopper for preventing disengagement of the terminal 4.

Although the above-mentioned preferred embodiment includes two terminal receiving chambers 2, a plurality of terminal receiving chambers 2 may be formed in the housing body 1 since the engagement part between the housing body 1 and the cover 6 is not complicated in structure according to the present invention as compared with the prior art, thereby maintaining a wiring work easy.

Second Preferred Embodiment

Figure 12A:
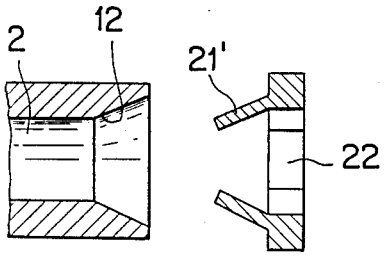

Referring to FIGS. 11 and 12*a*, there is provided flexible projection members 21′ which are preliminarily converged to the axis of the terminal insertion hole 22. The other constructional details are the same as of the first preferred embodiment.

Figure 12B:
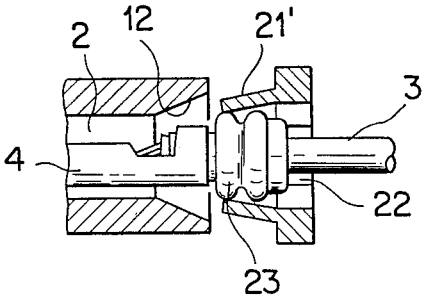
Figure 12C:
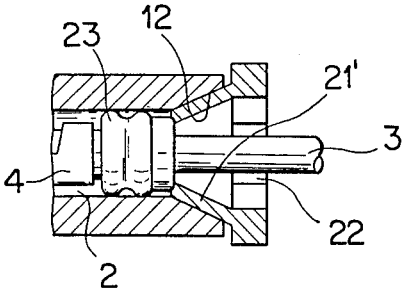

The cover 6 having the flexible projection members 21′ is temporarily mounted to the housing body 1 (first engaging condition), and then the terminal 4 with the lead wire 3 is inserted into the terminal insertion hole 22. In the course of insertion, the rubber plug 23 comes into contact with the flexible projection members 21′ as shown in FIG. 12*b*, and passes therethrough as expanding outwardly.

After the rubber plug 23 passes through the flexible projection members 21′, the latter is returned to its original consturction.

When the cover 6 is further urged against the housing body 1 to be completely mounted thereto, the flexible projection members 21′ function to stop the rubber plug, thereby preventing disengagement of the terminal 4.

While the invention has been described with reference to specific embodiments, the description is illustrative and is not be construed as limiting the scope of the invention. various modifications and changes may occur to those skilled in the art without departing from the spirit and scope of the invention as defined by the appended claims.

What is claimed is:

1. A connector housing comprising:

a housing body having a terminal receiving chamber for receiving a terminal connected with a lead wire, a tapered portion formed on an inner wall of said terminal receiving chamber is such a manner as to be converged in a direction of insertion of said terminal, and first and second locking means formed on an outer periphery of said housing body;

a cover for preventing disengagement of said terminal, having first and second engaging portions to be engaged with said first and second locking means, repsectively, a terminal insertion hole into which said terminal is inserted, and a flexible projection provided around said terminal insertion hole; and an elastically deformable soft band for integrally connecting said housing body with said cover; wherein said terminal is inserted under a first engaging condition where said second locking means of said housing body is merely in contact with said second engaging portion of said cover, and said flexible projection is urged along said tapered portion to stop a rear end of said terminal under a second engaging condition where said second locking means is fixedly engaged with said second engaging portion.

2. The connector housing as defined in claim 1, wherein said first locking mans comprises a pair of projections formed on both side surfaces of said housing body, and said second locking means comprises a first projection formed at an upper central portion of said housing body and a second projection formed at lower both ends of said housing body.

3. The connector housing as defined in claim 1, wherein said flexible projection comprises a plurality of tongue-like members arranged in parallel relationship with an axis of said terminal insertion hole.

4. The connector housing as defined in claim 1, wherein said flexible projection comprises a plurality of tongue-like members converged toward an axis of said terminal insertion hole.

5. The connector housing as defined in claim 1, wherein said terminal insertion hole of said cover is substantially axially aligned with said terminal receiving chamber of said housing body under said first engaging condition.

6. The connector housing as defined in claim 1, wherein said cover is provided at its upper portion with a U-shaped flexible member, and said second engaging condition is obtained by inwardly depressing both side surfaces of said U-shaped flexible member.

* * * * *